US006202361B1

(12) United States Patent
Thorp et al.

(10) Patent No.: US 6,202,361 B1
(45) Date of Patent: Mar. 20, 2001

(54) OVERHEAD SUSPENDED TABLE AND ACOUSTIC DOME

(75) Inventors: Clarkson S. Thorp, Wayland; Steven J. Beukema, Grand Rapids, both of MI (US)

(73) Assignee: Haworth, Inc., Holland, MI (US)

( * ) Notice: Subject to any disclaimer, the term of this patent is extended or adjusted under 35 U.S.C. 154(b) by 0 days.

(21) Appl. No.: 09/092,113

(22) Filed: Jun. 5, 1998

(51) Int. Cl.[7] ..... G09F 7/20

(52) U.S. Cl. ..... 52/39; 108/42; 108/149; 248/343

(58) Field of Search ..... 52/39; 108/42, 108/149; 248/343

(56) References Cited

U.S. PATENT DOCUMENTS 2,484,678 * 10/1949 Blumer .
2,580,980 * 1/1952 Vrooman .
2,827,350 * 3/1958 Galloway .
2,844,428 * 7/1958 Puntenney .
3,382,819 * 5/1968 Deutsch et al. .
4,441,282 * 4/1984 Thual ..... 52/39
4,815,396 * 3/1989 Gehring ..... 108/149
4,862,764 * 9/1989 Gehring ..... 74/606 R
5,947,416 * 9/1999 Kraft ..... 244/118.5

* cited by examiner

*Primary Examiner*—Carl D. Friedman
*Assistant Examiner*—Yvonne M. Horton
(74) *Attorney, Agent, or Firm*—Flynn, Thiel, Boutell & Tanis, P.C.

(57) ABSTRACT

A table which defines an upwardly facing work surface and an acoustic dome for use above the table, both of which are suspended from overhead and movable in a vertical direction downwardly to create a work area, and upwardly for storage whereby the dome nests within the table. The table includes a plurality of alternating writable and tackable work surfaces and is generally arcuate in shape. The dome includes an upwardly facing side and a downwardly facing side including a smooth material capable of reflecting sound towards the work area. The upwardly facing side of the dome includes a plurality of sound-absorbing ring members to minimize the entry of outside sound into the work area.

17 Claims, 10 Drawing Sheets

OVERHEAD SUSPENDED TABLE AND ACOUSTIC DOME

FIELD OF THE INVENTION

The present invention relates to a table which defines a work surface and an acoustic dome for use in an office-type environment and, more particularly, to an overhead suspended table and dome, both of which are adjustably movable vertically downwardly to create a work area, and upwardly for storage whereby the dome nests within the table.

BACKGROUND OF THE INVENTION

Most conventional work environments include work surfaces such as tables or desks which are typically used in combination with fixed walls or wall panel systems to create an enclosed work area such as an office. However, the demand for open-space office environments adapted for accommodating groups or teams of workers has increased. Accordingly, a need exists for an arrangement suited for such an open-space office environment which is easily storable when not in use.

SUMMARY OF THE INVENTION

It is an object of the invention to provide a table which creates a work area and defines a work surface for dissemination of various types of information to a group of people, and an acoustic dome for use above the table or other work area which serves to isolate sound generated at or near the work area and also serves to minimize entry of outside sound into the work area.

More specifically, the table in accordance with the invention includes a plurality of work surfaces, some of which are constructed of a material capable of being written on with erasable type markers, such as marker board, and others of which are constructed of a material suitable for posting information thereon, such as a rigid foam. These different work surfaces preferably alternate with one another along the length of the table. The table has an arcuate shape and is upwardly inclined from an inner to an outer edge to enable easy viewing of information displayed on the work surfaces. In addition, the table is suspended from overhead and is vertically movable upwardly and downwardly. The free space under the table is usable for storage of work-related items.

The invention also includes an acoustic dome which is preferably positioned centrally above the table or other work area for isolating sound generated near the work area and minimizing the entry of unwanted outside sound into the work area. The dome is also suspended from overhead and is movable vertically upwardly and downwardly. The dome is preferably of a size to permit same to nest within the table when the table is moved upwardly for overhead storage.

Other objects and purposes of the invention will be apparent to persons familiar with arrangements of this general type upon reading the following specification and inspecting the accompanying drawings.

Figure 1:
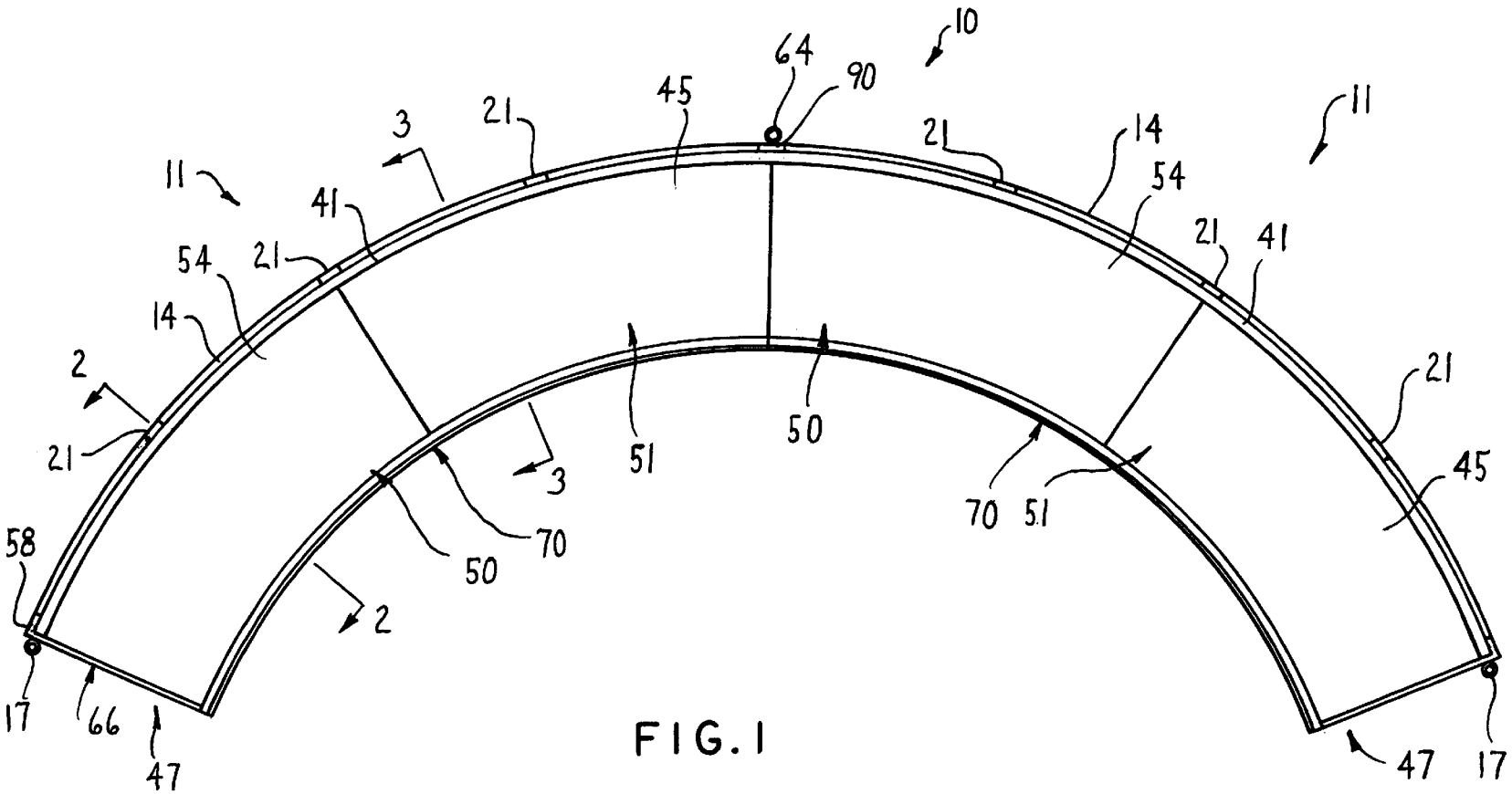
FIG. 1 is a top view of the table according to the present invention.

Certain terminology will be used in the following description for convenience in reference only, and will not be limiting. For example, the words "upwardly", and "downwardly", "rightwardly" and "leftwardly" will refer to directions in the drawings to which reference is made. The words "inwardly" and "outwardly" will refer to directions toward and away from, respectively, the geometric center of the arrangement and designated parts thereof. Said terminology will include the words specifically mentioned, derivatives thereof, and words of similar import.

DETAILED DESCRIPTION

Figure 2:
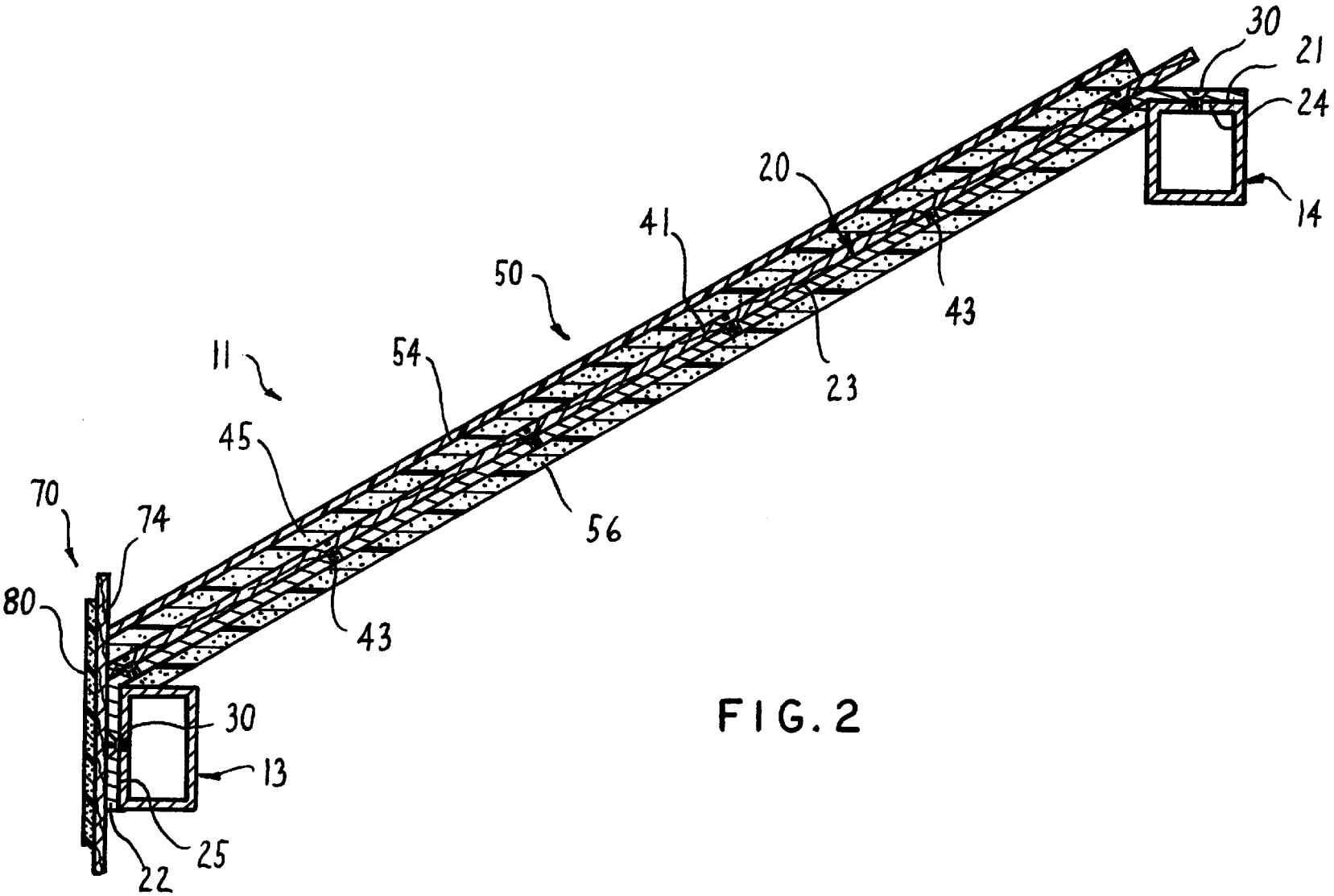
FIG. 2 is a cross-sectional view thereof taken substantially along line 2—2 in FIG. 1.
Figure 3:
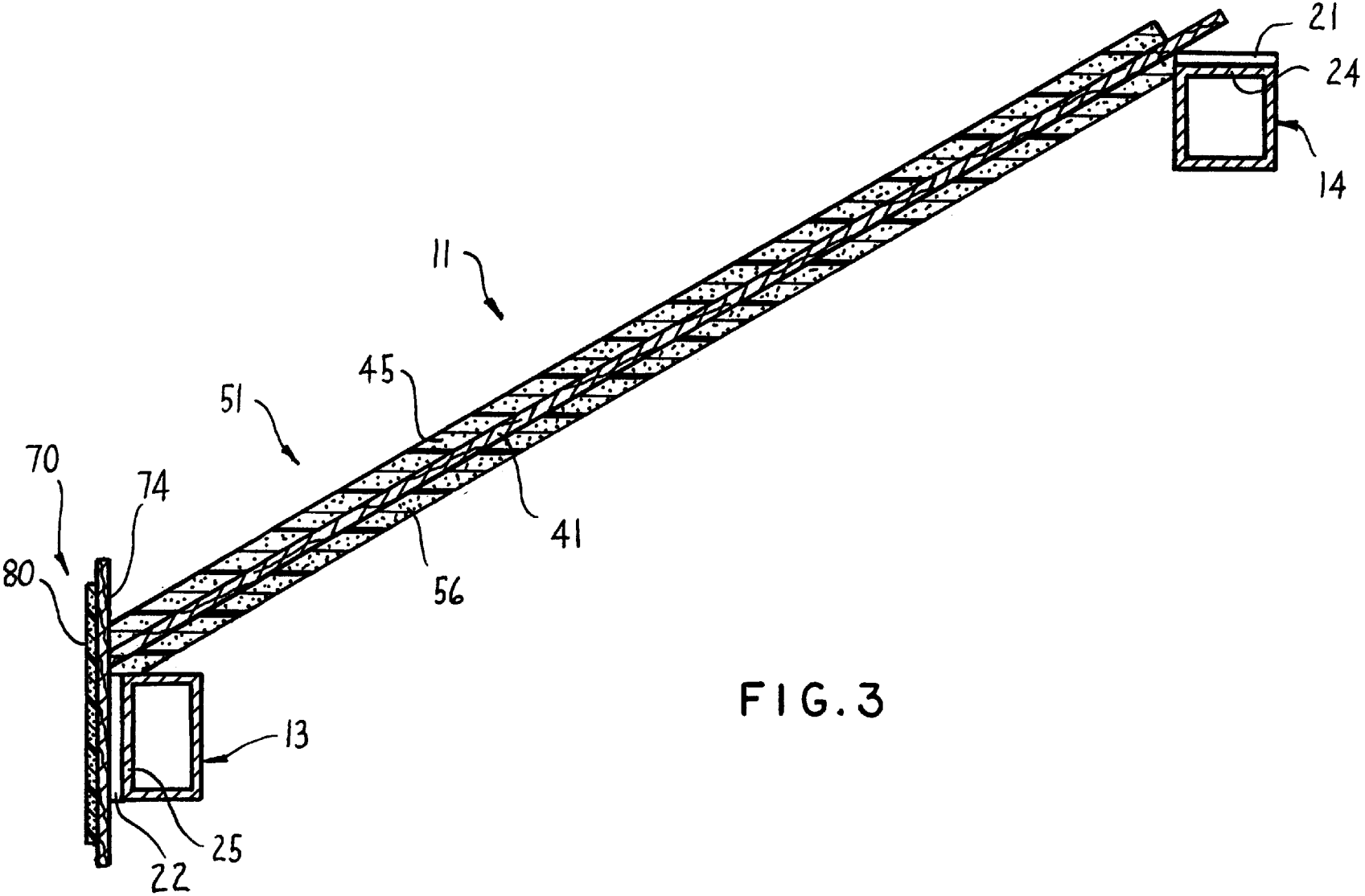
FIG. 3 is a cross-sectional view thereof taken substantially along line 3—3 in FIG. 1.

Referring to FIGS. 1–4A, there is illustrated a table 10 according to the present invention which includes a frame having two frame portions or frame halves 11 which are rigidly joined together in end-to-end relation. Each frame half 11 includes elongate and arcuate front and rear frame members 13 and 14. Each frame member 13 and 14 has a hollow box-like configuration. Specifically, rear frame member 14 preferably has a square cross-section, and front frame member 13 has a rectangular cross-section, as best shown in FIGS. 2–3.

With reference to FIGS. 2 and 3 which show a cross-sectional view of frame half 11, front frame member 13 is connected to rear frame member 14 by a plurality, and preferably three, elongate cross members 20 which extend transversely therebetween. Each cross member 20 includes a generally horizontally extending and flat platelike upper end 21 and a generally vertically extending flat platelike lower end 22, both of which are angled with respect to, and are adjoined to one another by an intermediate platelike straight portion 23. The upper end 21 of each cross member 20 is fixedly secured to an upwardly facing section 24 of rear frame member 14, and the lower end 22 of each cross member 20 is fixedly secured to a frontwardly facing section 25 of front frame member 13 by means of fasteners such as screws 30. The cross members 20 are preferably disposed in an evenly spaced-apart manner with respect to one another along the length of frame half 11.

Figure 1A:
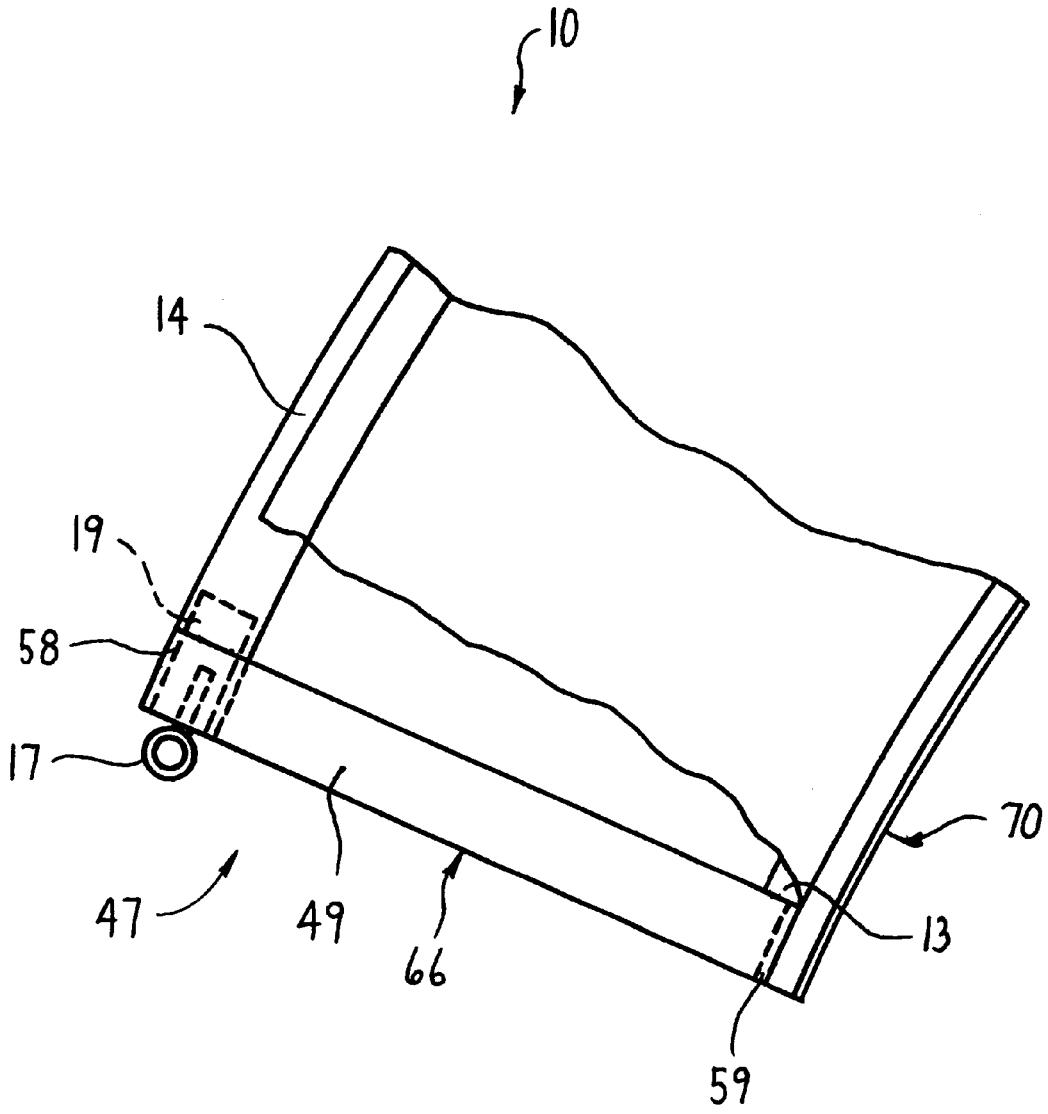
FIG. 1A is an enlarged, fragmentary top view thereof illustrating details of the frame thereof.

As shown in FIGS. 1 and 1A, each frame half 11 also includes a corner piece 47 at the outer end thereof. Corner piece 47 extends between and interconnects front and rear frame members 13 and 14 and includes a top section 49 having a generally horizontally extending flat upper end 58 similar to upper ends 21 of cross members 20, which upper end 58 is fixedly attached to upwardly facing section 24 of rear frame member 14 for example by screws (not shown). Top section 49 also includes a generally vertically extending flat lower end 59 similar to lower ends 22 of cross members 20, which lower end 59 is fixedly attached to frontwardly facing section 25 of front frame member 13. Further, corner piece 47 also includes a flat side section 66 which extends generally vertically and downwardly from an outer longitudinal edge of top section 49.

As also shown in FIGS. 1 and 1A, eye-type connectors 17 are preferably provided on opposite ends of table 10 and extend generally sidewardly therefrom. Each connector 17 (FIG. 1A) is fixedly fastened to a solid plug or frame segment 19 which is telescopingly disposed within rear frame member 14 and is secured thereto by fasteners such as screws (not shown). A shaft portion of connector 17 extends through side section 66 of corner piece 47 and into the end face of frame segment 19.

Figure 4:
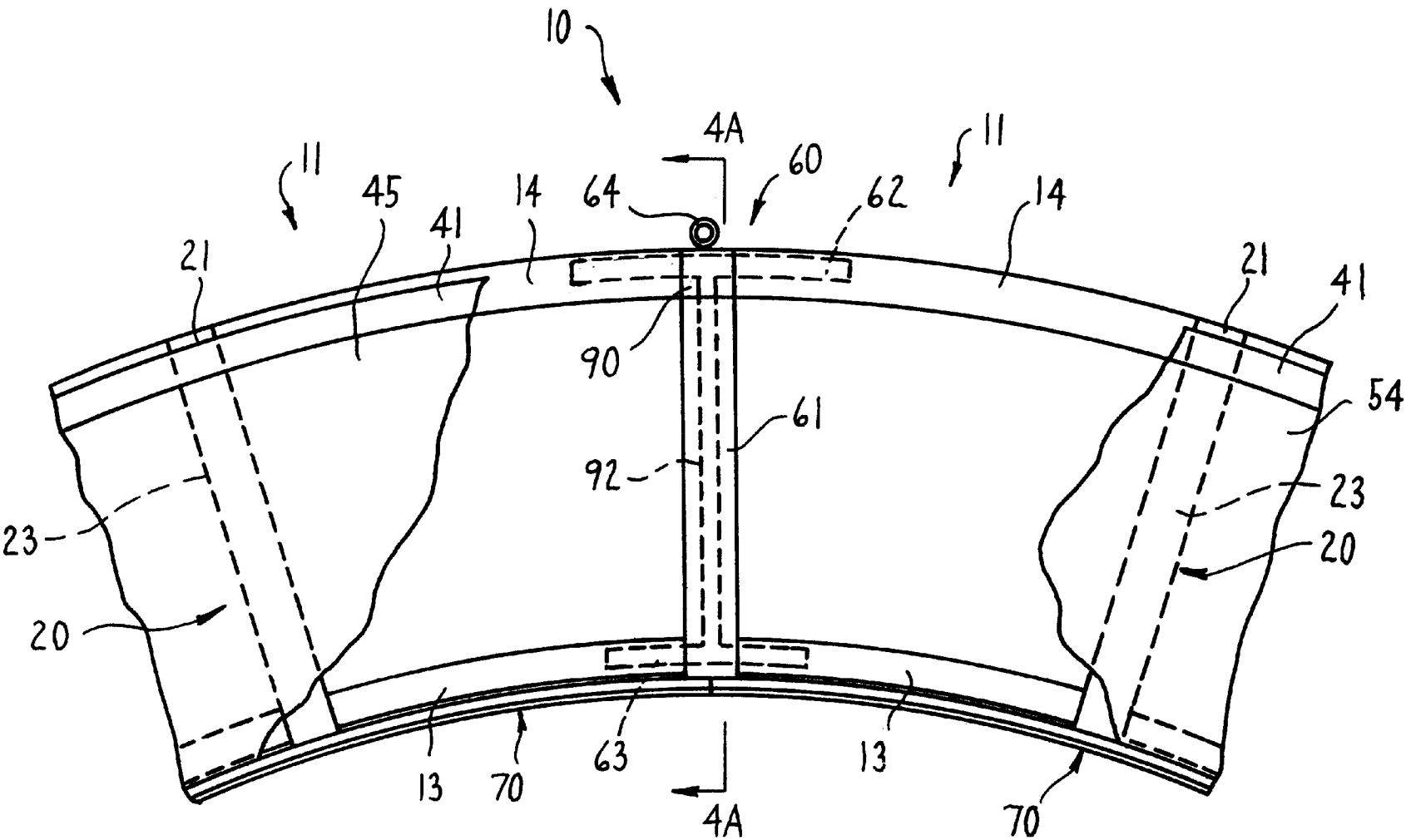
FIG. 4 is an enlarged, fragmentary top view illustrating details of the frame thereof.
Figure 4A:
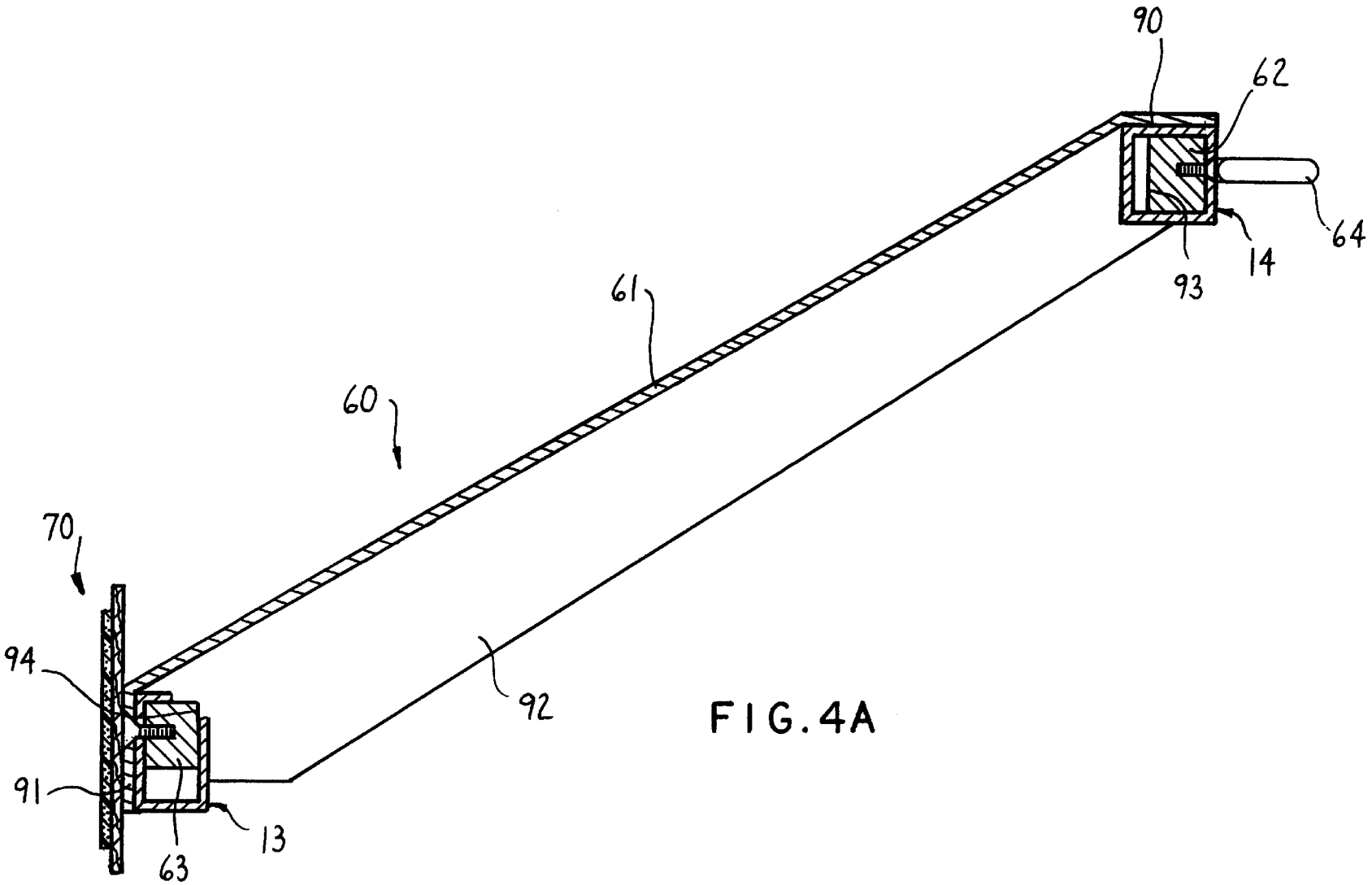
FIG. 4A is a cross-sectional view thereof taken substantially along line 4A—4A in FIG. 4.

Referring to FIGS. 1, 4 and 4A, frame halves 11 are preferably rigidly fastened to one another in end-to-end relationship by means of a connector member 60 having an elongate, flat top section 61 and upper and lower cross bars 62 and 63 extending generally transversely from opposite ends of the top section 61, thereby providing the connector member 60 with an I-shape. The upper and lower sections 62 and 63 each have an arcuate shape having a curvature which substantially matches the curvature of the rear frame member 14 and the front frame member 13, respectively. The top section 61 of the connector 60 preferably includes a generally horizontally extending flat upper end 90 and a generally vertically extending flat lower end 91, similar to the respective upper and lower ends of cross members 20. A reinforcing flange 92 extends from a downwardly facing side of top section 61 and is substantially perpendicular thereto.

Upper and lower cross bars 62 and 63 are preferably connected by welding to upper and lower edges 93 and 94 of flange 92, respectively (FIG. 4A). In this regard, upper cross bar 62 is spaced slightly downwardly away from upper end 90 of top section 61 so as to form a gap therebetween, and lower cross bar 63 is spaced rearwardly away from lower end 91 of top section 61 to form a gap therebetween. An eye-type connector 64 is fixedly fastened to a rearwardly facing section of upper cross bar 62 at a central area thereof.

The connector member 60 is preferably constructed of a lightweight metal such as aluminum.

To fasten the frame halves 11 to one another, the frame halves 11 and 12 are placed in an aligned end-to-end relation so as to generally form a semi-circular configuration with the connector member 60 sandwiched therebetween. The ends of upper cross bar 62 are then slidingly and telescopingly inserted into the open inner ends of the rear frame members 14 remote from corner pieces 47, and the ends of lower cross bar 63 are slidingly inserted into the open inner ends of the front frame members 15 remote from corner pieces 47 until the inner ends of the frame members lie closely adjacent flange 92 of connector member 60. In this regard, the shaft portion of eye connector 64 is sandwiched between the inner terminal ends of rear frame members 14. The upper cross bar 62 is then fixedly attached to rear frame members 14, and the lower cross bar 63 is fixedly attached to front frame members 13 by fasteners such as screws (not shown).

The above-discussed fastening arrangement of frame halves 11 places the rear frame members 14 above, and horizontally offset rearwardly from their respective front frame members 13, which provides the table 10 with an approximately 30° front-to-back inclination.

As shown in FIGS. 2–3, each frame half 11 respectively includes an enlarged sheetlike panel member 41, preferably constructed of a rigid material such as hardboard. The panel member 41 substantially covers frame half 11 and has an upper edge which angularly projects above the upwardly facing section 24 of rear frame member 14. Panel member 41 is fastened to the intermediate portion 23 of each cross member 20, to the top sections 49 of corner pieces 47, and to the top section 61 of connector member 60 by means of fasteners such as screws 43. Panel member 41 may be a one-piece panel or may include multiple panels.

Each frame half 11 also includes an enlarged sheet of foam-like material 45 which covers substantially the entire respective panel member 41 and is attached thereto by means of an adhesive. The sheet 45 is preferably constructed of a rigid foam which is puncturable and capable of resiliently gripping fasteners such as tacks, and may also be utilized with self-stick notes such as Post-it brand notes which will readily adhere to the rigid foam sheet 45.

With reference to FIG. 1, each frame half 11 includes two adjacent and arcuate panel sections 50 and 51 which, when frame halves 11 are assembled, define a plurality of work surfaces. The panel section 50 of each frame half 11 (FIG. 2) preferably includes an enlarged sheet 54 of smooth and rigid material, such as a marker board which is capable of being written upon by ink markers of the erasable type. The marker board sheet 54 is fixedly attached by adhesive atop the foam sheet 45 so as to cover approximately one-half the upper surface area thereof, thus leaving about one-half of the upper surface area of the foam sheet 45 exposed to define the adjacent panel section 51 (FIG. 3).

The entire underside or downwardly facing side of each of the hardboard panel 41 is preferably covered with a sheet 56 of flexible foam-like material, such as acoustic (i.e. sound absorbing) foam, which sheet 56 is fastened to panel 41 by an adhesive.

Each of the frame halves 11 also includes an elongate, generally vertically oriented arcuate lip or flange 70. Flange 70 is fixedly attached to front frame member 13, for example by screws (not shown) which extend through the lower ends 22 of cross members 20, the lower ends 59 of corner pieces 47 and the lower end 91 of connector 60. The flanges 70 extend along substantially the entire length of front frame members 13 and define the forwardmost edge of table 10. The flanges 70 each include a rigid inner member 74 constructed of hardboard having a layer 80 of rigid foam-like material adhered to a frontwardly facing surface thereof. The foam layer 80 is preferably of the same or a similar material as the foam sheet 45 and may be used for posting information thereon. The rigid inner member 74 is preferably attached to front frame member 13 prior to the attachment of the foam layer 80 to inner member 74, so that the fasteners (not shown) used to fasten the inner member 74 to the front frame member 13 are not visible in the assembled condition of the table 10.

The flanges 70 are preferably oriented transversely with respect to the panel sections 50 and 51 and extend upwardly past same and downwardly past front frame members 13 to provide an enlarged surface for posting information thereon. In addition, work items such as writing utensils, papers, etc. may be placed on any of the panel sections 50 and 51 and will be retained thereon by means of a rearwardly facing surface of flange 70.

Frame members 13–14, cross members 20, and corner pieces 47 are all preferably constructed of a lightweight metal such as aluminum.

In the assembled condition, the table 10 includes the panel sections 50–51 which together define a continuous work surface which includes alternating individual sections 50 and 51 having different capabilities. That is, panel sections 50 function as writable surfaces, and panel sections 51 function as surfaces capable of having information posted thereon by fasteners such as tacks.

Figure 7:
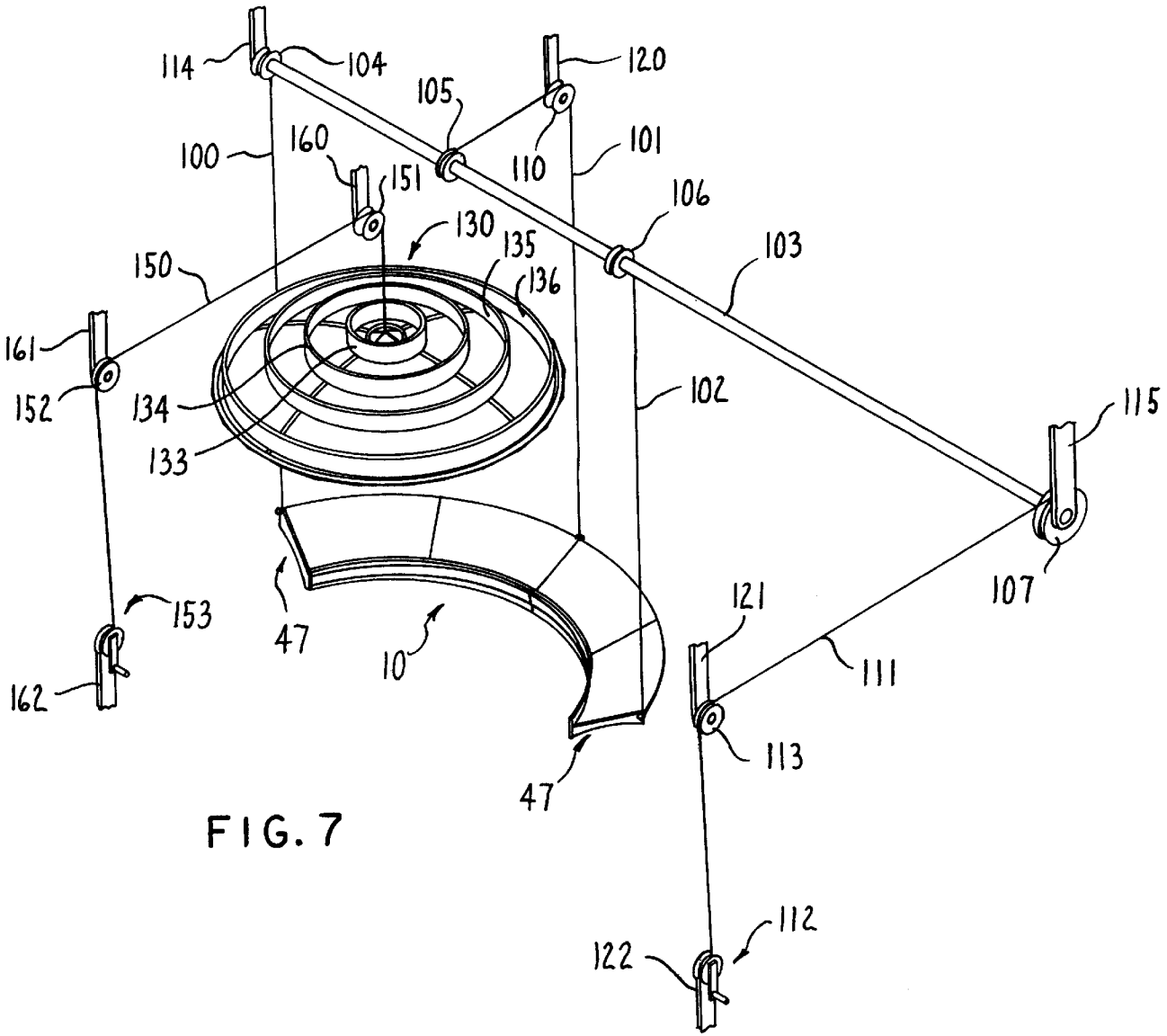
FIG. 7 is an elevational view of the table and dome illustrating same in a working position.
Figure 9:
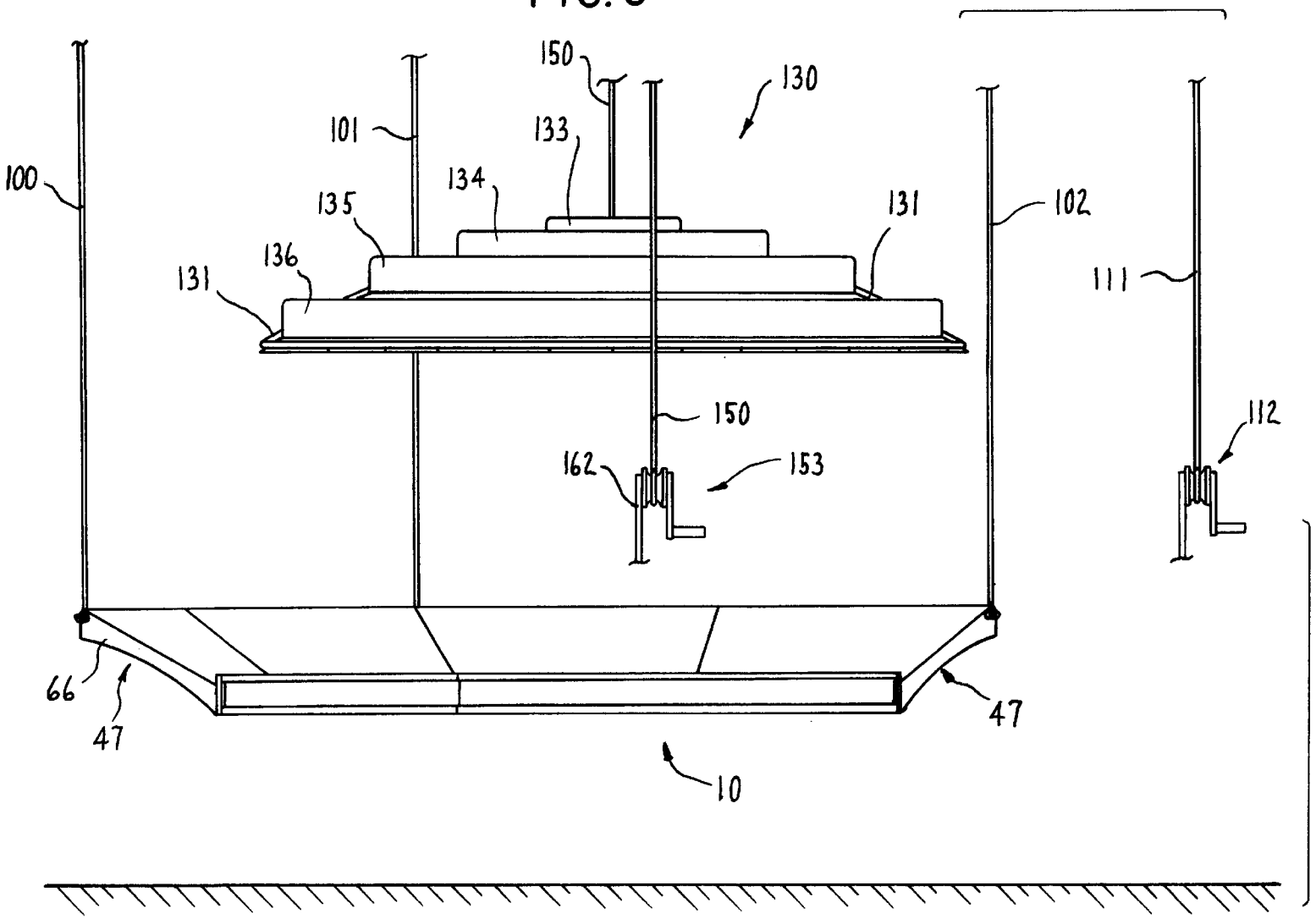
FIG. 9 is a side view of the table and dome in a working position.

As shown in FIGS. 7 and 9, the table 10 is preferably suspended from overhead by means of three cables 100, 101 and 102 from three suspension points. The lower ends of each of the cables 100–102 preferably include a conventional hook (not shown) which is fastened to a respective one of the connectors 17 and 64. The upper ends of the cables 100–102 are associated with a control shaft 103 including four winding drums 104, 105, 106 and 107, all of which are nonrotatably attached to the control rod 103. The upper ends of cables 100 and 102 are wound around winding drums 104 and 106, respectively, and the upper end of cable 101 is looped over a pulley 110 and wound around winding drum 105. The terminal end of each cable 100, 101 and 102 is fixedly (i.e. nonmovably) attached to each winding drum 104, 105 and 106, respectively.

An additional cable 111 is utilized to operate the control shaft 103. One end of cable 111 is wound around winding drum 107 (the terminal portion thereof being nonmovably attached thereto) and the other end of which is wound around a winding drum of a manual control mechanism 112 with the terminal end thereof being fixedly attached thereto. The cable 111 is looped over an additional pulley 113 interposed between control mechanism 112 and winding drum 107.

The control shaft 103 is rotatably mounted to a stationary overhead structure (such as a ceiling) at each end thereof by means of mounting brackets 114 and 115. Similarly, pulleys 110 and 113 are rotatably mounted to a stationary overhead structure by means of mounting brackets 120 and 121, and control mechanism 112 is rotatably mounted by means of a mounting bracket 122 to a stationary structure such as a floor or wall. All of the mounting brackets 114, 115, 120, 121 and 122 are only partially shown in FIG. 7 for purposes of simplicity.

The table 10 may be raised and lowered by manipulating the control mechanism 112. For example, by rotating the handle of the control mechanism 112 in a clockwise direction with respect to FIG. 7, the cable 111 rotates winding drum 107 and thus control rod 103 in a counterclockwise direction. The rotation of control rod 103 in the counterclockwise direction causes winding drums 104–106 to rotate in the counterclockwise direction and to wind in the cables 100–102 so as to raise the table 10 from the position shown in FIG. 7. Oppositely, rotating the control handle 112 in the counterclockwise direction would serve to lower the table 10 from the position shown in FIG. 7. Thus, the table 10 may be lowered to the desired working position so that materials or information placed thereon are viewable by persons either standing or sitting, or raised into a non-working or storage position well above the floor and out of the way so that the area underneath can be used for another purpose if desired.

It should be understood that the control mechanism 112 is only schematically shown and includes a conventional locking mechanism for locking the table 10 in the desired vertical position.

It should also be understood that the above-discussed suspension mechanism is provided as only one example of such a mechanism, and other mechanisms may be utilized in accordance with the invention. In this regard, the control mechanism 112 is shown and described here as being manually operable, however, a conventional motor may be provided to drive the control rod 103, which motor may be controlled by an electronic controller having control buttons or switches usable by the operator to raise and lower the table 10 to the desired position.

The table 10 in accordance with the invention preferably has an outer diameter of approximately 16 feet and an inner diameter of approximately 12 feet as generated about a common axis. It should be understood that the above diameters are given only by way of example.

Figure 6:
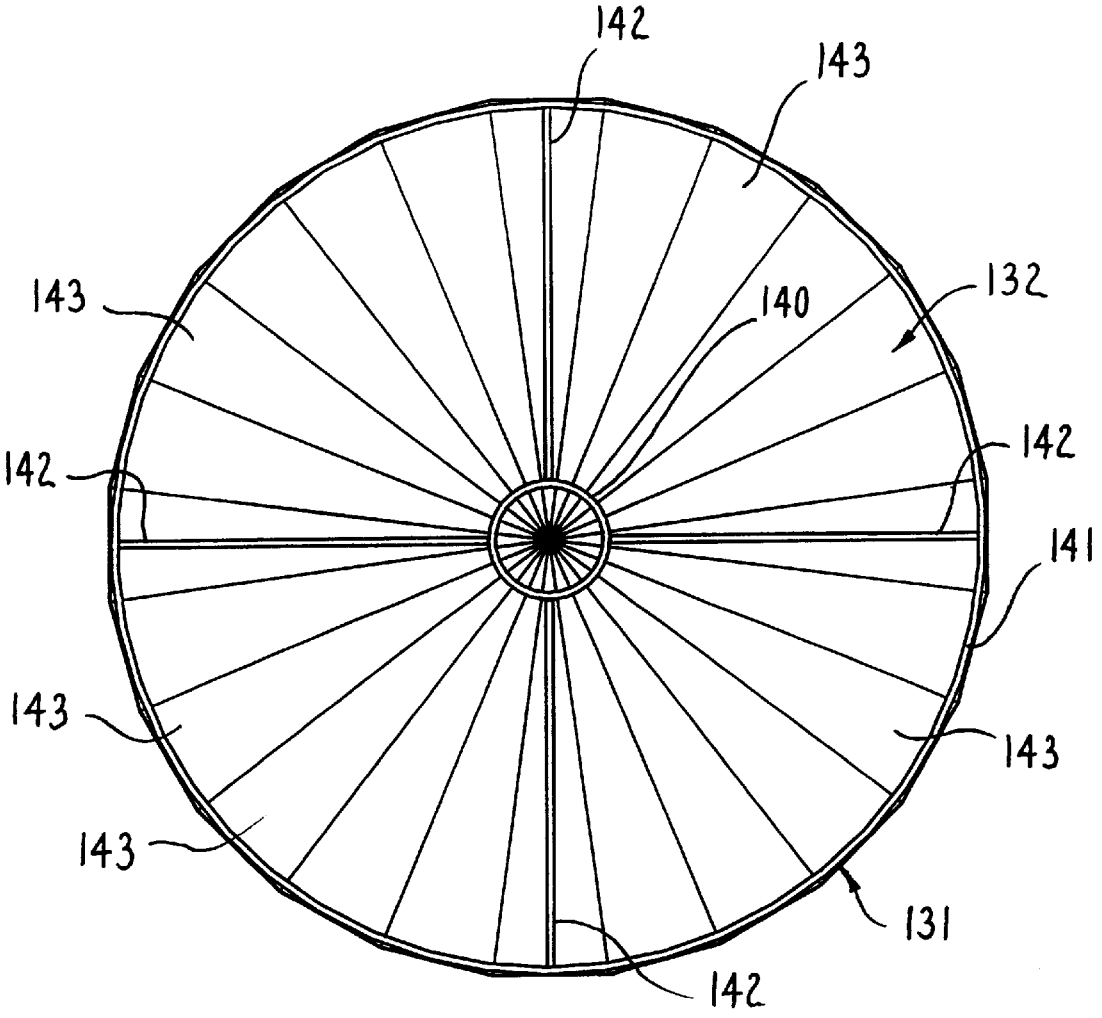
FIG. 6 is a top view thereof.
Figure 5:
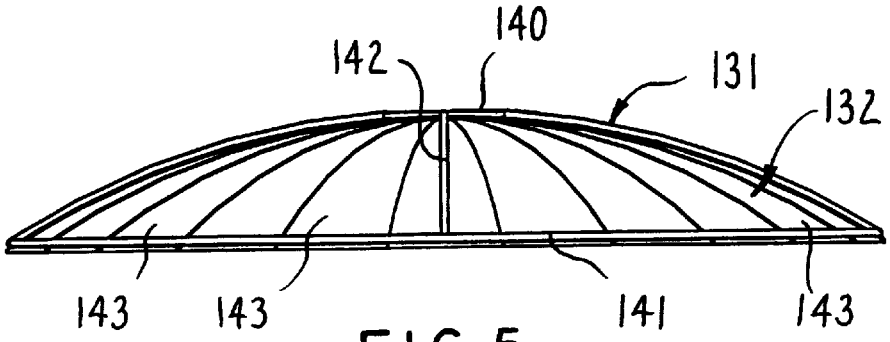
FIG. 5 is a side view of the dome according to the present invention without the ring members.
Figure 8:
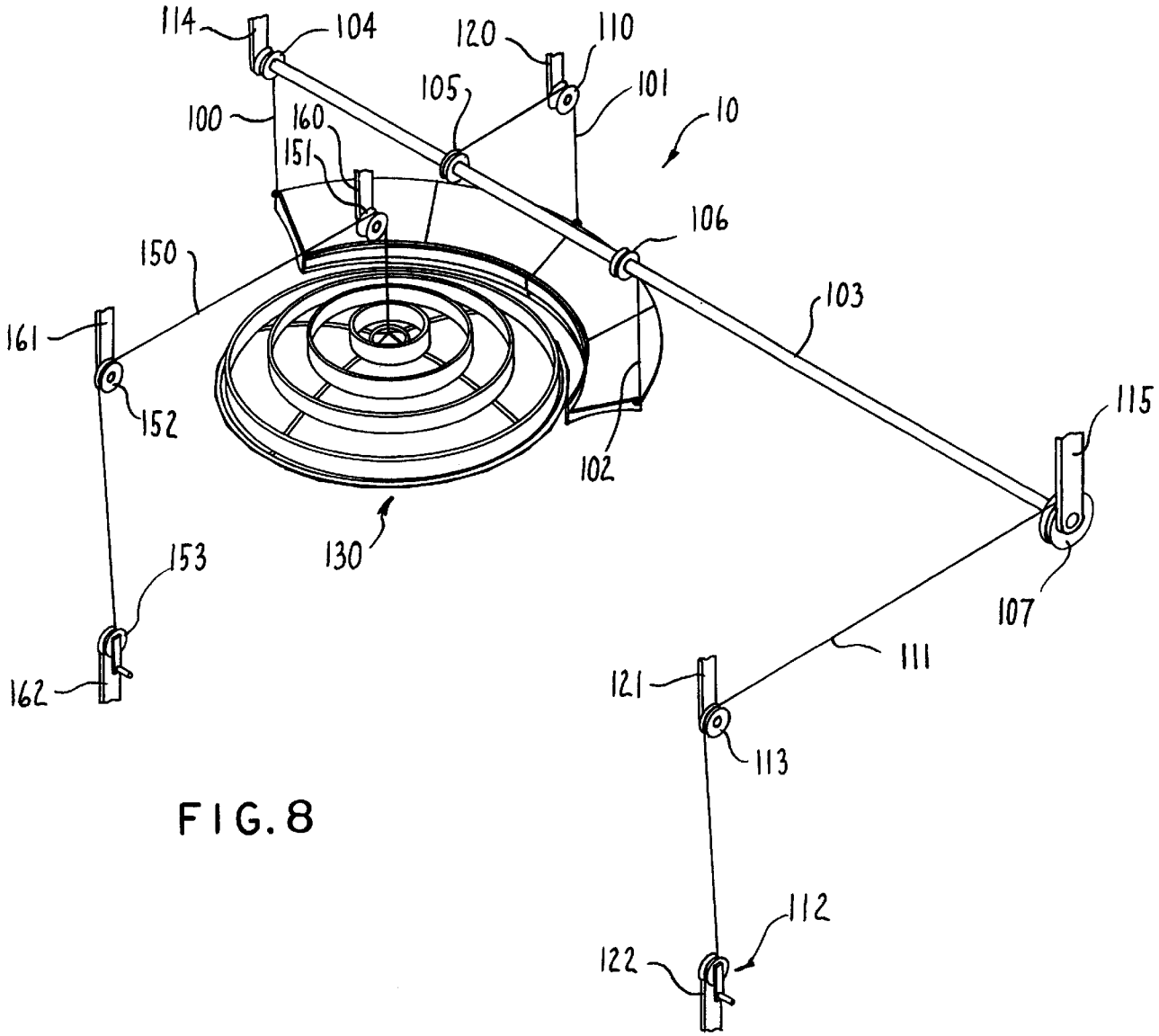
FIG. 8 is a view similar to FIG. 7 but showing the table and dome in a raised storage configuration.

The disclosure now turns to an acoustic dome 130 for use above a designated work area. With reference to FIGS. 5–9, the dome 130 preferably includes a partial spherically shaped open support frame 131, a partial spherically shaped inner shell portion 132 mounted on the frame 131, and a plurality and preferably four ring members 133, 134, 135 and 136 of increasing outer diameter concentrically mounted on and projecting upwardly of the shell portion 132 (FIGS. 7–9). In this regard, FIGS. 5 and 6 show only the support frame 131 and the inner shell portion 132 of the dome 130 without the ring members 133–136 for purposes of clarity.

The open support frame 131 is embodied by an inner ring 140 disposed concentrically within and above an outer ring 141, which rings 140 and 141 are connected to one another by rounded (i.e. downwardly curving) radially extending cross members or spokes 142 spaced at approximately 90° angles from one another, each cross member 142 having one end welded to inner ring 140 and another end welded to outer ring 141. The inner and outer rings 140 and 141, and cross member 142 are preferably constructed of aluminum tubing.

The inner shell portion 132 preferably includes a plurality of triangular or pie-piece shaped sheet-like members 143 having inner pointed edges which meet one another at the center of inner ring 140, and straight outer edges located adjacent and extending slightly outwardly past outer ring 141. The triangular members 143 of shell portion 132 are preferably constructed of a smooth polymeric material such as polypropylene, and preferably fluted polypropylene.

The triangular members 143 are fixedly attached by rivets to a downwardly facing side of frame 131 and define the downwardly facing inner surface of the dome 130. Specifically, the outer edge of each triangular member 143 is riveted to the outer ring 141, and the inner portion of each triangular member 134 is riveted to the inner ring 140 such that the sides of the members 143 snugly contact or abut one another and form a substantially continuous inner shell portion 132 without gaps.

The ring members 133–136, as shown in FIGS. 7–9, are fixedly mounted by adhesive on an upwardly facing side of the triangular members 143, such that the support frame 131 is sandwiched therebetween. The smallest ring member 133 is mounted concentrically about inner ring 140 of frame 131, and the larger ring members 134, 135 and 136 are mounted in order of increasing diameter concentrically about the smallest ring member 133 such that the largest ring member 136 is disposed adjacent and slightly inside an outer periphery of the dome 130 defined by the outermost straight edges of the triangular members 143.

The ring members 133–136 are preferably constructed of a polymeric material capable of absorbing sound, so that entry of unwanted sound generated outside the work area into the work area is minimized. For example, the ring members 133–136 may be constructed of unwoven polyester similar to that which is utilized for automobile air filters, or to that which is used as batting for lining quilt-type blankets. It should be understood that the above is presented only as one example of a type of material which may be utilized in accordance with the invention, and that other sound absorbing materials may be utilized.

The downwardly facing smooth side of the inner shell portion 132 serves to reflect sound generated at or near the work area towards the work area, and the ring members 133–136 serve to absorb unwanted sound generated outside the work area so as to minimize disturbance caused by entry of same into the work area.

As shown in FIGS. 7–9, the dome 130 is preferably suspended from overhead by means of a cable 150, two pulleys 151 and 152, and a control mechanism 153. One end of cable 150 is fixedly attached to inner ring 140 by means of a linkage including four cable segments which are fixedly attached to and extend radially outwardly from the terminal end of cable 150 for attachment to the inner ring 140 at approximately 90° intervals from one another (FIG. 7). Other means of attaching cable 150 to dome 130 may be utilized, and the above is presented as only one example of one such attachment mechanism. The other end of cable 150 is wound around a winding drum of control mechanism 153 (the terminal end of cable 150 being fixedly attached thereto) and the intermediate portion of cable 150 is looped over pulleys 151 and 152.

The dome 130 is thus raised and lowered by manipulating the control mechanism 153. Specifically, to raise the dome 130 from the position shown in FIG. 7, the handle of control mechanism 153 is turned in a clockwise direction so that the cable 150 is wound around the winding drum of control mechanism 153. To lower the dome 130, the winding drum of control mechanism 153 is turned in a counterclockwise direction so as to unwind cable 150 and thus lower dome 130 to the desired position.

It should be understood that the control mechanism 153, like control mechanism 112, is schematically shown and would include a conventional locking mechanism to lock the dome 130 in the desired vertical position.

Each of the pulleys 151 and 152 are rotatably mounted to a stationary overhead structure by means of mounting brackets 160 and 161, respectively. Control mechanism 153 is preferably rotatably mounted by means of a mounting bracket 162 which may be fixedly attached to a stationary structure, such as the floor.

The dome 130 in accordance with the invention preferably has a diameter which is slightly smaller than the inner diameter of the table 10, such as a diameter of approximately 10 feet, and is disposed on the same center axis as the table.

FIGS. 7–9 illustrate the dome 130 in use with the table 10, whereby the dome 130 is preferably positioned generally centrally above table 10. The dome 130 and table 10 are shown in one possible working position in FIGS. 7 and 9, and in one possible storage or non-use position in FIG. 8. As shown in FIG. 8, the dome 130 is of a size such that same is nestable within the table 10 in the raised storage position such that the outer periphery of the dome 130 lies closely adjacent the forwardmost edge of table 10.

In addition, it may be desirable to mount work related objects such as speakers for an intercom system or lighting to the support frame 131 of the dome 130.

It may also be desirable to mount lighting fixtures or other work related items equipped with a spring-loaded or otherwise adjustable clip to the uppermost exposed edge of hardboard panel members 41 and 42 of table 10, or to the upper and lower exposed edges of hardboard inner members 74 and 75 of flanges 70 and 71, respectively.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. An overhead suspended table, comprising:

a support frame including horizontally elongate front and rear frame members spaced-apart from one another and each having an arcuate shape, said rear frame member being disposed above and horizontally offset rearwardly from said front frame member, a panel member having an arcuate shape and being fixedly attached to said front and rear frame members such that said panel member is inclined upwardly from a front edge thereof toward a rear edge thereof; and an adjustment suspension mechanism connected to said frame and suspending said frame and said panel member from an overhead structure in a generally horizontal manner.

2. The table of claim 1 including a lip disposed along said front frame member transversely with respect to said panel member, said lip including a frontwardly facing portion of a material capable of permitting attachment of information thereon.

3. The table of claim 1 wherein said frame includes a plurality of cross-members disposed in a spaced-apart manner with respect to one another and extending between and interconnecting said front and rear frame members, said panel member being fixedly attached to each said cross-member.

4. The table of claim 1 wherein said front and rear frame members each have a hollow interior and a generally rectangular cross-section.

5. The table of claim 1 wherein said suspending means includes control means for raising and lowering said table with respect to a generally horizontal surface such as a floor.

6. The table of claim 1 wherein said panel member defines a plurality of work surfaces, a first plurality of said work surfaces each including a smooth surface capable of functioning as a marker board for permitting writing thereon, a second plurality of said work surfaces being of a material capable of permitting attachment of information thereon, and said first and second work surfaces being disposed in an alternating manner along said table.

7. The table of claim 1 including a sheet of foam-like material fixedly attached to a downwardly facing surface of said panel member and extending across the entirety thereof.

8. The table according to claim 1, wherein said suspension mechanism is attached solely to said rear frame member so as to provide open access to said panel member from adjacent said front edge thereof.

9. An overhead suspended table, comprising:

a support frame including horizontally elongate front and rear frame members spaced-apart from one another and each having an arcuate shape, said rear frame member being disposed above and horizontally offset rearwardly from said front frame member, a panel member disposed on said support frame and defining an upwardly facing worksurface; and means for adiustably suspending said frame and said panel member from an overhead structure in a generally horizontal manner, said suspending means including a plurality of fastening members disposed in a spaced-apart manner with respect to one another along said rear frame member.

10. The table of claim 9 wherein said plurality of fastening members includes three fastening members, first and second ones of said fastening members being disposed at opposite ends of said rear frame member and a third of said fastening members being disposed at a middle of said rear frame member.

11. The table of claim 10 wherein said suspending means includes a plurality of cables and means for synchronously raising and lowering each of said ends and said middle of said rear frame member, said cables each having a first end connected to a respective one of said fastening members and a second end associated with said means for synchronously raising and lowering.

12. The table arrangement of claim 10 wherein said first, second and third fastening members are the sole fastening members for suspending said table from an overhead structure.

13. The table according to claim 9, wherein said front frame member is free of said fastening members so as to provide open access to said panel member from adjacent a front concave edge thereof.

14. An overhead suspended table, comprising:

a worksurface having elongate front and rear edges, said rear edge being disposed above and horizontally offset rearwardly of said front edge so that said worksurface is inclined upwardly from said front edge thereof to said rear edge thereof; and a suspension mechanism connected to said worksurface and an overhead support structure, said suspension mechanism adjusting the height of said worksurface between a lowered working position and a raised storage position.

15. The table according to claim 14, wherein said worksurface is arcuate and supported on elongate front and rear frame members, said suspension mechanism being connected to said rear frame member.

16. The table according to claim 15, wherein said suspension mechanism includes a drum assembly and three cables fixed at one end thereof to said rear frame member and at the other end to said drum assembly on which said cables wind to move said worksurface into said storage position and unwind to move said worksurface to said working position.

17. The table according to claim 16, wherein said drum assembly includes a control shaft and three separate drums fixed on said control shaft and respectively receiving said cables, first and second said cables being fixed to terminal ends of said rear frame member and extending essentially vertically upwardly therefrom for connection to respective first and second said drums, said rear frame member being arcuate, a third said cable being fixed to said rear frame member at a location defined substantially centrally between said terminal ends thereof, and said suspension mechanism including a pulley positioned rearwardly of a third said drum and supporting said third cable so as to extend essentially vertically downwardly therefrom for connection to said rear frame member, said third cable extending horizontally from said pulley to said third drum.

* * * * *

UNITED STATES PATENT AND TRADEMARK OFFICE

CERTIFICATE OF CORRECTION

PATENT NO. : 6,202,361 B1
DATED : March 20, 2001
INVENTOR(S) : Steven J. Beukema It is certified that error appears in the above-identified patent and that said Letters Patent is hereby corrected as shown below:

Title page,
Item [75], please replace with
-- [75], Inventor: Steven J. Beukema, Grand Rapids, MI (US) --

Signed and Sealed this

Twenty-ninth Day of January, 2002

*Attest:*

*Attesting Officer*

JAMES E. ROGAN
*Director of the United States Patent and Trademark Office*